US011927347B2

(12) United States Patent
Fan

(10) Patent No.: US 11,927,347 B2
(45) Date of Patent: Mar. 12, 2024

(54) BENDABLE LIGHTER

(71) Applicant: Jiangsu Tianwang Solar Technology Co., Ltd., Jingjiang (CN)

(72) Inventor: Jiawei Fan, Jingjiang (CN)

(73) Assignee: JIANGSU TIANWANG SOLAR TECHNOLOGY CO., LTD., Jingjiang (CN)

( * ) Notice: Subject to any disclaimer, the term of this patent is extended or adjusted under 35 U.S.C. 154(b) by 562 days.

(21) Appl. No.: 17/203,714

(22) Filed: Mar. 16, 2021

(65) Prior Publication Data

US 2021/0199295 A1 Jul. 1, 2021

Related U.S. Application Data

(63) Continuation-in-part of application No. PCT/CN2018/114755, filed on Nov. 9, 2018.

(30) Foreign Application Priority Data

Sep. 20, 2018 (CN) ..... 201811102298.1

(51) Int. Cl.
*F23Q 3/01* (2006.01)
*F23Q 3/00* (2006.01)

(52) U.S. Cl.
CPC ..... *F23Q 3/01* (2013.01); *F23Q 3/002* (2013.01); *F23Q 3/006* (2013.01)

(58) Field of Classification Search
CPC . F23Q 3/002; F23Q 3/01; F23Q 3/006; F21V 33/0024
See application file for complete search history.

(56) References Cited

U.S. PATENT DOCUMENTS

| | | | | |
|---|---|---|---|---|
| 9,964,305 | B1 * | 5/2018 | Brady | F23Q 3/01 |
| 10,488,043 | B2 * | 11/2019 | Bao | F23Q 3/006 |
| 2002/0094500 | A1 * | 7/2002 | Tse | F23Q 2/163 431/153 |
| 2016/0040877 | A1 * | 2/2016 | Mohamedali | F23Q 3/01 431/258 |

(Continued)

FOREIGN PATENT DOCUMENTS

| | | | |
|---|---|---|---|
| CN | 2628895 | * | 7/2004 |
| CN | 204100292 | * | 1/2015 |
| CN | 204460281 | * | 7/2015 |

(Continued)

*Primary Examiner* — Alfred Basichas
(74) *Attorney, Agent, or Firm* — MATTHIAS SCHOLL P.C.; Matthias Scholl

(57) ABSTRACT

The disclosure provides a bendable lighter, including an ignition head; a handle, the handle including a housing, the housing including a body, a cavity, a first end, and a second end; a deformable bar disposed on the first end of the handle; a support disposed on one end of the deformable bar away from the handle; a lamp disposed on the first end of the handle and on one side of the deformable bar; an ignition coil; a printed circuit board; an ignition switch; a lighting switch; a polymer battery; an ignition button; a lighting button; a power indicator; a USB interface; and a power switch. The ignition head is fixedly disposed on the support; the ignition coil, the printed circuit board, and the polymer battery are disposed in the cavity in order from the first end to the second end.

5 Claims, 2 Drawing Sheets

(56) References Cited

U.S. PATENT DOCUMENTS

| | | | | |
|---|---|---|---|---|
| 2021/0063015 | A1* | 3/2021 | Fan | F23Q 3/002 |
| 2021/0199295 | A1* | 7/2021 | Fan | F23Q 3/002 |

FOREIGN PATENT DOCUMENTS

| | | | |
|---|---|---|---|
| CN | 204648310 | * | 9/2015 |
| CN | 207716459 | * | 8/2018 |
| CN | 207762959 | * | 8/2018 |

* cited by examiner

BENDABLE LIGHTER

CROSS-REFERENCE TO RELATED APPLICATIONS

This application is a continuation-in-part of International Patent Application No. PCT/CN2018/114755 with an international filing date of Nov. 9, 2018, designating the United States, now pending, and further claims foreign priority benefits to Chinese Patent Application No. 201811102298.1 filed on Sep. 20, 2018. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, MA 02142.

BACKGROUND

The disclosure relates to the field of a bendable lighter.

A lighter is a portable device which generates a flame, and can be used to ignite a variety of items, such as cigarettes, gas stoves, fireworks, candles or campfire.

Conventional lighters include a rigid straight bar and thus are not easy to ignite stoves or cooking utensils in a curved corner. The handle of conventional lighters is made of aluminum alloy, which has the hidden risk of electric leakage. In addition, conventional lighters include no lamp, which is inconvenient for use in dark environments.

SUMMARY

The disclosure provides a bendable lighter, comprising an ignition head; a handle, the handle comprising a housing, the housing comprising a body, a cavity, a first end, and a second end; a deformable bar disposed on the first end of the handle; a support disposed on one end of the deformable bar away from the handle; a lamp disposed on the first end of the handle and on one side of the deformable bar; an ignition coil; a printed circuit board; an ignition switch; a lighting switch; a polymer battery; an ignition button; a lighting button; a power indicator; a USB interface; and a power switch.

The ignition head is fixedly disposed on the support; the ignition coil, the printed circuit board, and the polymer battery are disposed in the cavity in order from the first end to the second end; the polymer battery is connected to the printed circuit board via a wire; the second end is in in the shape of a semicircle and in transition connection to the body of the handle; the second end comprises a through hole; and the through hole and the semicircle are concentric; the housing comprises an upper cover and a lower cover detachably connected to the first cover; the ignition button and the lighting button are disposed on the upper cover and are connected to the ignition switch and the lighting switch, respectively; the power indicator is disposed on one side of the lighting button; the housing further comprises a side wall, and the USB interface and the power switch are disposed on the side wall.

In a class of this embodiment, the ignition head comprises a first layer and a second layer covering the first layer; the first layer is ceramic, and the second layer comprises a zinc alloy. In a class of this embodiment, the deformable bar is straight or curved.

In a class of this embodiment, the housing of the handle comprises engineering plastic, and the handle comprises a surface comprising at least one microgroove.

In a class of this embodiment, the power indicator comprises four marks showing a state of charge of the polymer battery is 100%, 75%, 50%, and 25%, respectively.

The following advantages are associated with the bendable lighter according to embodiments of the disclosure. The polymer battery of the lighter is connected to the printed circuit board via a wire, and the printed circuit board has the functions of overcurrent, overvoltage and overtemperature protection, thus improving the safety property of the lighter. The housing of the handle comprises engineering plastic, which can effectively prevent electric leakage. The ignition bar is deformable and suitable for various scenes and angles. The inner layer of the ignition head is ceramic, which is insulative; the outer layer a zinc alloy, thus increasing the strength of the lighter. The front end of the handle comprises a lighting lamp, which is suitable for use in dark environments. The printed circuit board of the lighter comprises an intelligent chip with delay protection function, short circuit protection function, electricity display function, charge/discharge protection and total power supply protection, thus improving the safety of the lighter.

Figure 1:
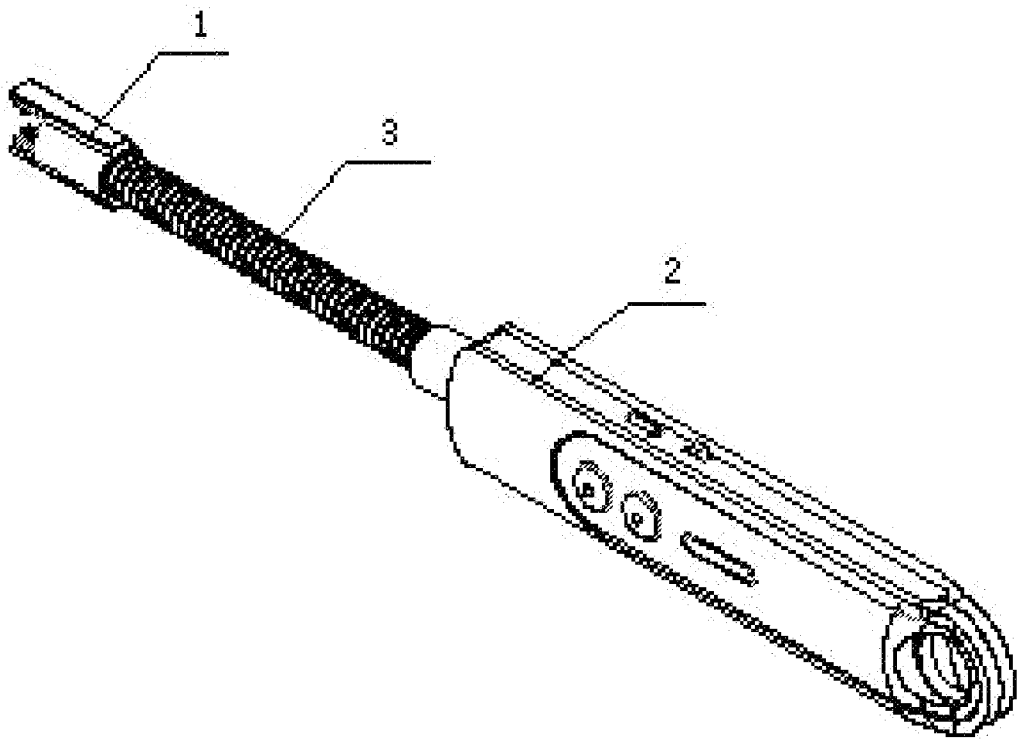
FIG. 1 is a schematic diagram of a bendable lighter according to one embodiment of the disclosure.

In the drawings, the following number references are used: 1. Ignition head; 2. Handle; 3. Deformable bar; 4. Support; 5. Lamp; 6. Ignition coil; 7. Printed circuit board; 8. Ignition switch; 9. Lighting switch; 10. Polymer battery; 11. Through hole; 12. Housing; 13. Upper cover; 14. Lower cover; 15. Ignition button; 16. Lighting button; 17. Power indicator; 18. USB interface; and 19. Power switch.

DETAILED DESCRIPTION

To further illustrate the disclosure, embodiments detailing a bendable lighter are described below. It should be noted that the following embodiments are intended to describe and not to limit the disclosure.

Figure 2:
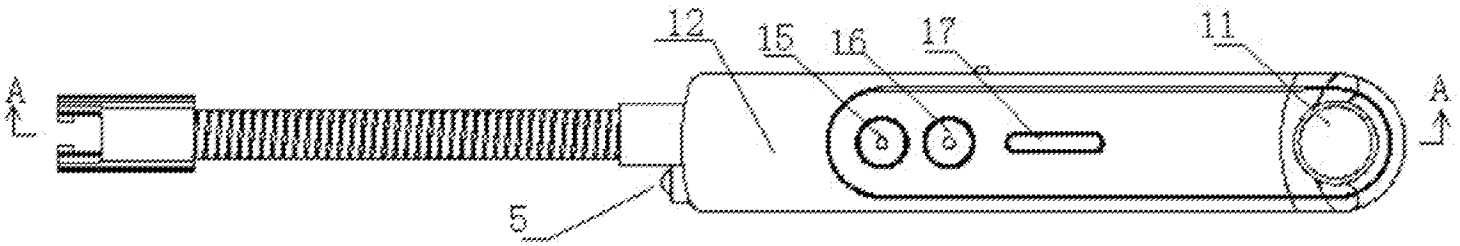
FIG. 2 is a front view of a bendable lighter according to one embodiment of the disclosure.
Figure 3:
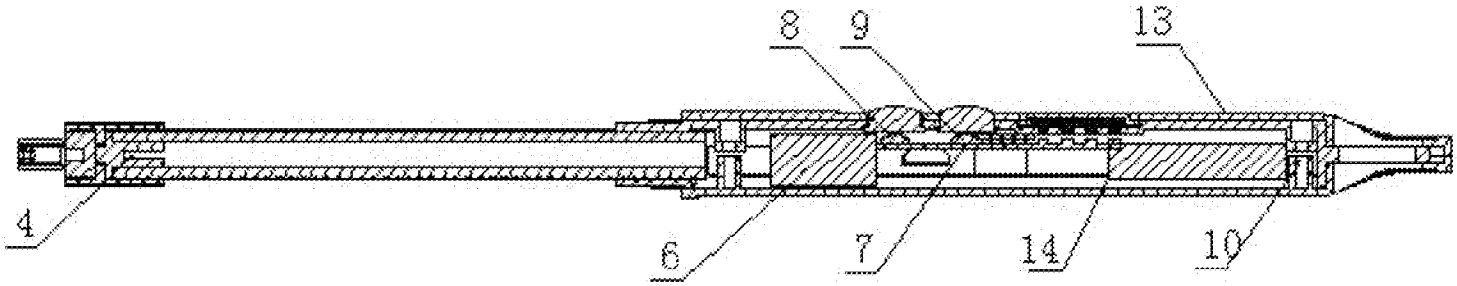
FIG. 3 is a sectional view of a bendable lighter taken from line A-A in FIG. 2.
Figure 4:
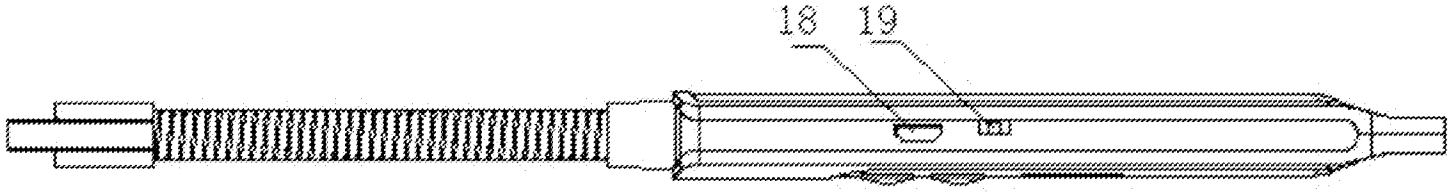
FIG. 4 is a top view of a bendable lighter taken from line A-A in FIG. 2.

As shown in FIGS. 1-4, provided is a bendable lighter comprising an ignition head 1; a handle 2 comprising a housing 12, the housing comprising a body, a cavity, a first end, and a second end; a deformable bar 3 disposed on the first end of the handle 2; a support 4 disposed on one end of the deformable bar 3 away from the handle; a lamp 5 disposed on the first end of the handle 2 and on one side of the deformable bar 3; an ignition coil 6; a printed circuit board 7; an ignition switch 8; a lighting switch 9; a polymer battery 10; an ignition button 15; a lighting button 16; a power indicator 17; a USB interface 18; and a power switch 19.

The ignition head 1 is fixedly disposed on the support 4; the ignition coil 6, the printed circuit board 7, and the polymer battery 10 are disposed in the cavity in order from the first end to the second end; the polymer battery 10 is connected to the printed circuit board 7 via a wire; the second end is in in the shape of a semicircle and in transition connection to the body of the handle; the second end comprises a through hole 11; and the through hole and the semicircle are concentric; the housing comprises an upper cover 13 and a lower cover 14 detachably connected to the first cover 13; the ignition button 15 and the lighting button 16 are disposed on the upper cover 13 and are connected to the ignition switch 8 and the lighting switch 9, respectively; the power indicator 17 is disposed on one side of the lighting button 16; the housing further comprises a side wall, and the USB interface 18 and the power switch 19 are disposed on the side wall.

In certain embodiments, the ignition head comprises a first layer and a second layer covering the first layer; the first layer is ceramic, and the second layer comprises a zinc alloy. The deformable bar 3 is straight or curved, with arbitrary bending directions and arbitrary bending angles.

In certain embodiments, the housing of the handle 2 comprises engineering plastic, and the handle 2 comprises a surface comprising at least one microgroove. The power indicator 17 comprises four marks showing a state of charge of the polymer battery 10 is 100%, 75%, 50%, and 25%, respectively.

When in use, the ignition head is 4-6 mm away from the ignition point. The handle is made of acrylonitrile-butadiene-styrene (ABS) engineering plastic, and the upper cover and the lower cover are secured to each other in a built-in mode, which improves the structural stability of the lighter. The lighter can be electroplated with various colors, improving the physical appearance thereof. The power switch is configured to open and close the ignition head, which increases the safety of the lighter.

The polymer battery of the lighter is connected to the printed circuit board via a wire, and the printed circuit board has the functions of overcurrent, overvoltage and overtemperature protection, thus improving the safety property of the lighter. When the ignition time is more than 1 minute, the ignition head will automatically turn off, exhibiting a delay protection function. The printed circuit board comprises a short-circuit protection circuit. The power indicator can show the state of charge of the polymer battery. The printed circuit board further comprises a charge/discharge protection circuit and power supply protection circuit.

The work of the ignition head is controlled by both the power switch and the ignition button. When to ignite, the power switch is pushed to ON, and the power indicator will be on, and then press the ignition switch to ignite the ignition head. Only turn on the power switch or press the ignition switch, the ignition cannot be realized; when lighting is needed, press the LED lighting button, the lighting can be realized.

It will be obvious to those skilled in the art that changes and modifications may be made, and therefore, the aim in the appended claims is to cover all such changes and modifications.

What is claimed is:

1. A device, comprising:

an ignition head;

a handle, the handle comprising a housing, the housing comprising a body, a cavity, a first end, and a second end;

a deformable bar disposed on the first end of the handle;

a support disposed on one end of the deformable bar away from the handle;

a lamp disposed on the first end of the handle and on one side of the deformable bar;

an ignition coil;

a printed circuit board;

an ignition switch;

a lighting switch;

a polymer battery;

an ignition button;

a lighting button;

a power indicator;

a USB interface; and a power switch;

wherein:

the ignition head is fixedly disposed on the support;

the ignition coil, the printed circuit board, and the polymer battery are disposed in the cavity in order from the first end to the second end;

the polymer battery is connected to the printed circuit board via a wire;

the second end is in in the shape of a semicircle and in smooth transition connection to the body of the handle; the second end comprises a through hole; and the through hole and the semicircle are concentric;

the housing comprises an upper cover and a lower cover detachably connected to the first cover; the ignition button and the lighting button are disposed on the upper cover and are connected to the ignition switch and the lighting switch, respectively;

the power indicator is disposed on one side of the lighting button; and the housing further comprises a side wall, and the USB interface and the power switch are disposed on the side wall.

2. The device of claim 1, wherein the ignition head comprises a first layer and a second layer covering the first layer; the first layer is ceramic, and the second layer comprises a zinc alloy.

3. The device of claim 1, wherein the deformable bar is straight or curved.

4. The device of claim 1, wherein the housing of the handle comprises engineering plastic, and the handle comprises a surface comprising at least one microgroove.

5. The device of claim 1, wherein the power indicator comprises four marks showing a state of charge of the polymer battery is 100%, 75%, 50%, and 25%, respectively.

* * * * *